United States Patent [19]

Matsui et al.

[11] Patent Number: 4,538,407

[45] Date of Patent: Sep. 3, 1985

[54] METHOD OF AND APPARATUS FOR SPLICING SPUN YARNS

[75] Inventors: Isamu Matsui, Kyoto; Koji Deno, Shiga, both of Japan

[73] Assignee: Murata Kikai Kabushiki Kaisha, Japan

[21] Appl. No.: 565,927

[22] Filed: Dec. 27, 1983

[30] Foreign Application Priority Data

Dec. 12, 1982 [JP] Japan ..... 57-230476

[51] Int. Cl.[3] ..... D01H 15/00

[52] U.S. Cl. ..... 57/22; 57/261

[58] Field of Search ..... 57/22, 261, 202, 263

[56] References Cited

U.S. PATENT DOCUMENTS

| | | | |
|---|---|---|---|
| 2,515,172 | 7/1950 | Abbott | 57/315 X |
| 4,292,796 | 10/1981 | Mima | 57/22 |
| 4,322,943 | 4/1982 | Rohner | 57/22 X |
| 4,361,003 | 11/1982 | Bertolli | 57/22 |
| 4,411,128 | 10/1983 | Mima | 57/22 |

*Primary Examiner*—Donald Watkins

*Attorney, Agent, or Firm*—Spensley, Horn, Jubas & Lubitz

[57] ABSTRACT

A pneumatic yarn splicing method and apparatus for spun yarns. Extremities of ends of the yarn which are inserted in overlapping and oppositely directed relationship in a yarn splicing hole are in free conditions and at least two different points of the yarn ends within the splicing hole are individually acted upon by flows of a fluid turning in opposite directions.

17 Claims, 38 Drawing Figures

Y5
Y4
Y3
Y2
Y2b
C1
Y2a
C2
Y2b
Y1
C1
M
C2

METHOD OF AND APPARATUS FOR SPLICING SPUN YARNS

BACKGROUND OF THE INVENTION

This invention relates to a method of and an apparatus for splicing spun yarns.

A method is conventionally employed wherein end portions of yarns overlapped one on the other are acted upon by a compressed fluid in order to splice such yarn ends to each other.

In an apparatus which employs such yarn splicing technique, such as an apparatus disclosed in a U.S. Pat. No. 4,002,012, two yarn ends are inserted into a yarn splicing hole so as to be directed in opposite directions to each other and compressed air is injected into the yarn splicing hold to oscillate or turn the overlapping portions of the yarn ends, thereby interlacing yarn end portions with each other to effect splicing of the yarns. In this apparatus, if overlapping portions of the yarn ends are both clamped at two respective different positions thereof and segments of a particular dimension of the overlapping portions of the two yarns which are thus arrested within a particular section are turned, then fibers of the yarn end segments between the clamped points thereof will be enveloped to one another by temporary twisting, the attaining intended splicing of the yarns. In such yarn splicing, however, extremities of the yarns outside the clamped portions extend from the opposite ends of the clamped portions and will remain as antennae to the yarns thus spliced. Such antennae may possibly be caught by a knitting needle in a subsequent knitting step to cause breakage of the yarn, thereby deteriorating the quality of a product such as a fabric and textiles.

Also, according to the apparatus as described above, fibers around a spliced joint may partially be coiled around each other in an opposite direction to the direction of twisting peculiar to the yarns and thus run in parallel relationship. As a result, the spliced joint of the yarns will not present sufficient strength nor sufficient thickness. In particular, if substantially the center between the overlapping portions of the ends of both yarns is acted upon by an injected turning air flow in a direction, then the overlapping portions are ballooned and the yarn ends on opposite sides of the acting point of the compressed air are twisted in opposite directions to each other so that one of the yarn ends is provided with a twist in the same direction to the twisting direction peculiar to the one yarn while the other yarn is provided with a twist in the opposite direction to the twisting direction peculiar to the other yarn. Accordingly, one portion of the spliced joint will be increased in strength while the other portion of the spliced joint will be reduced in strength, and since the maximum value of tensile strength of the spliced joint is determined by the weakest portion of the spliced joint, the entire spliced joint will have such a reduced strength.

SUMMARY OF THE INVENTION

An object of the present invention is to provide a yarn splicing method which assures a spliced joint which has substantially the same strength and thickness as those of individual single yarns to be spliced to each other.

In particular, the present invention is characterized in that, spun yarns to be spliced to each other having a twist of one direction peculiar thereto, extremities of ends of the yarns which are inserted in overlapping and oppositely directed relationship in a yarn splicing hole are in free conditions and at least two different points of said yarn ends which are overlapped one on the other within said yarn splicing hole are individually acted upon by flows of a fluid turning in opposite directions such that they may be individually untwisted by the respective turning fluid flows, thereby assuring a spliced joint of yarns to be formed which has an actual twist having the same direction with the direction peculiar to the original yarns. Thus, according to the present invention, a spliced joint of yarns can be obtained which has a structure very similar to the structure of the original yarns and which has substantially the same strength, stretch and twisting number as a single yarn.

BRIEF DESCRIPTION OF THE DRAWINGS

FIG. 14 being a plan view, FIG. 15 a side elevational view and FIG. 16 a front elevational cross sectional view;

DETAILED DISCLOSURE OF THE INVENTION

A principle of a yarn splicing method according to the present invention will be described with reference to FIG. 1.

It is to be noted here that the term "yarn" as used in the following description shall generally apply to a spun yarn consisting either of a bundle of staple fibers, that is, natural fibers such as cotton, wool, hemp and so on, and chemical long fibers which are cut short, or of a bundle of such mixed fibers. However, endless long chemical fibers may also be applied to the present invention if the conditions are partially modified suitably. Further, it is assumed that a "yarn" has a twisting number peculiar thereto which is represented by the number of twists per inch and that such twists are distributed substantially uniformly over the entire length of the yarn.

Figure 1:
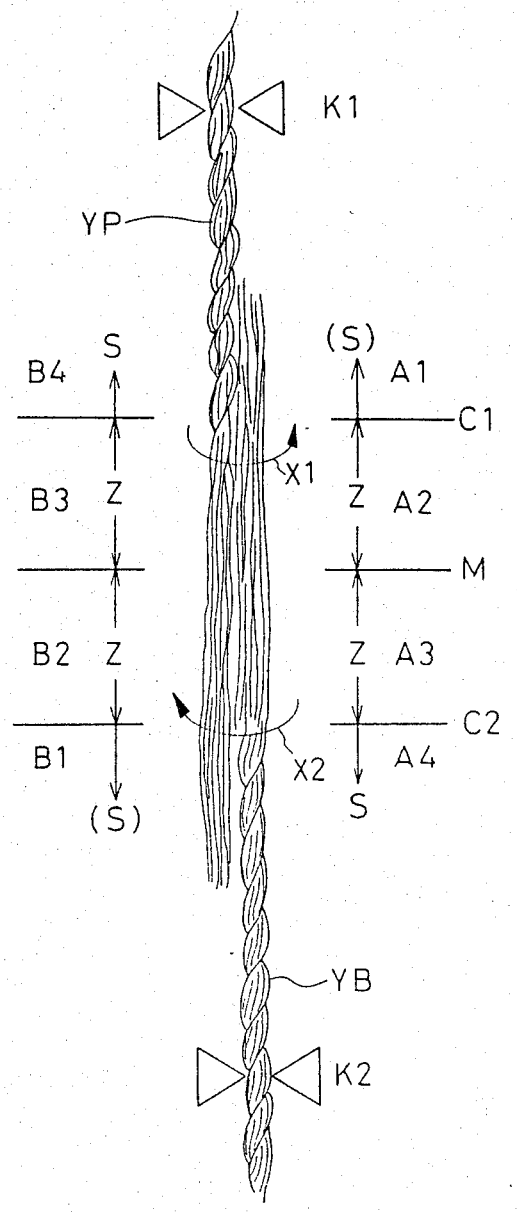
FIG. 1 is a diagrammatic representation illustrating a principle of the method according to the present invention.

Referring to FIG. 1, one yarn is cut to provide two separate yarn ends YP and YB. The yarn ends YP, YB are directed in opposite directions to each other and are overlapped one on the other in a parallel or crossing relationship to each other. Extremity portions of both yarn ends are untwisted for preparation of splicing of the yarns. The untwisted portions are portions at which twists peculiar to the yarn are either substantially zero or rather smaller in number than the number of twists peculiar to the yarn, and preferably the yarn ends are reduced to no twist conditions in which fibers constituting each yarn run substantially in parallel relationship to each other.

Further, the extremity portions of the ends of the yarns YP, YB are not constrained and thus remain in free conditions while each yarn YP, YB is clamped at a point thereof which is spaced a predetermined fixed distance from the extremity thereof so that it may not be untwisted beyond the clamped point K1 or K2 thereof, which thus provides a fixed point.

In this condition, both yarns YP, YB are turned in opposite directions X1 and X2 at two different points C1 and C2 of the overlapping area thereof. In particular, the turning directions are determined in association with twisting directions peculiar to the yarns to be spliced to each other, and the turning direction at the position C1 is selected to be the direction X1 in which the peculiar twist of portions of the yarns between the clamped point K1 of the yarn YP and the twisting point C1 due to turning of the yarns is released or untwisted while the turning direction at the position C2 is selected to be the direction X2 in which the peculiar twist of portions of the yarns between the other clamped point K2 of the yarn YB and the twisting point C2 is released or untwisted. The yarns YP and YB shown are represented to have peculiar twists in a Z direction, but it is obvious that, where a yarn has an S twist, the turning directions X1, X2 are reversed.

It is to be noted that a turning flow of a fluid provided by injection thereof is employed for means for turning yarns and especially an air flow may be employed which is most available.

Now, behaviors of yarns caused by such a turning action as described above will be described.

Here, for facilitation of description, a segment of the yarn YB between the clamped point K2 and the extremity of the end thereof is divided into four sections A1 and A4.

In particular, the section A1 is a section between the extremity of the yarn end and the turning flow applying point C1; the section A2 is a section from the turning flow applying point C1 to the center M of the turning providing point C1, C2; the section A3 is a section from the center M to the turning providing point C2; and the section A4 is a section from the turning providing point C2 to the other clamped point K2. Similarly, the other yarn YP is divided into sections B1 to B4 from the extremity of the yarn end.

The sections A1, A2 of the yarn YB and the sections B3, B4 of the yarn YP are turned in the direction as shown by the arrow mark X1 by a turning flow at the turning providing point C1 in the direction of the arrow mark X1.

In this case, an S twisting force is applied to portions of the yarns in the sections A1 and B4 while a Z twisting force is applied to portions of the yarns in the sections A2 and B3. But, since the yarn YB in the section A1 is in a free or open-ended condition, the S twist disappears from the yarn section A1 while the actual Z twist remains in the yarn YB in the section A2. At the same time, fibers unspun from the yarns in the sections A2 and A3 are interlaced and united with each other and are twisted in the Z twist while the end portion of the yarn in the section A1 is interlaced in the Z direction with a portion of the yarn YP in the section B4 and is thus twisted progressively. If a portion of the yarn YP in the section B4 is in an unspun condition, then fibers in the sections A1 and A4 are also interlaced and united with one another, thereby forming a single yarn of the Z twist.

It is to be noted, however, that since the portion of the yarn YP in the section B4 is turned in the direction to release the twist peculiar to the yarn, it tends to be untwisted thereby, but if the yarn portions in the sections B3 and B4 are held to the utmost from being turned, then the portions of the yarn YB in the A1 and A2 sections will be turned principally around the other yarn YP. As a result, the yarn YB is wound or twisted in the Z direction around the yarn YP while it is further twisted into the Z twist around itself.

Further, turning of the yarns in the direction of the arrow mark X2 at the other turning providing point C2 will also cause similar phenomena to those as described above. In this case, the end portion of the yarn YP in the section B1 is in a free condition, and hence, while the Z twist is also provided to the portion of the yarn YP in the section B2, fibers of the yarn YP in the sections B1, B2 will be interlaced and united with fibers of the yarn YB, thereby forming a single yarn which is twisted in the Z direction.

Accordingly, the end portions A1, A2 of the yarn YB positioned adjacent the turning providing point C1 relative to the center or mid point M between the turning providing point C1 and C2 are progressively twisted in the Z direction, that is, in the same direction as the peculiar twisting direction of the yarn and are wound around the portions of the yarn YP in the sections B4 and B3 while the end portions of the yarn YP in the sections B1 and B2 positioned on the C2 side relative to the mid point M are twisted in the Z direction, that is, in the same direction to the peculiar twisting direction of the yarn and are wound around the portions of the yarn YB in the sections A4 and A3. As a result, the twist in the same direction as the original twisting direction of the yarns is provided over the entire area of the spliced joint thus formed, and depending upon untwisted conditions of overlapping portions of yarn ends before splicing thereof, the joint after splicing of the yarns will come to have a similar structure to that of the original yarn.

Figures 2, 3A, 3B, 3C, 3D:
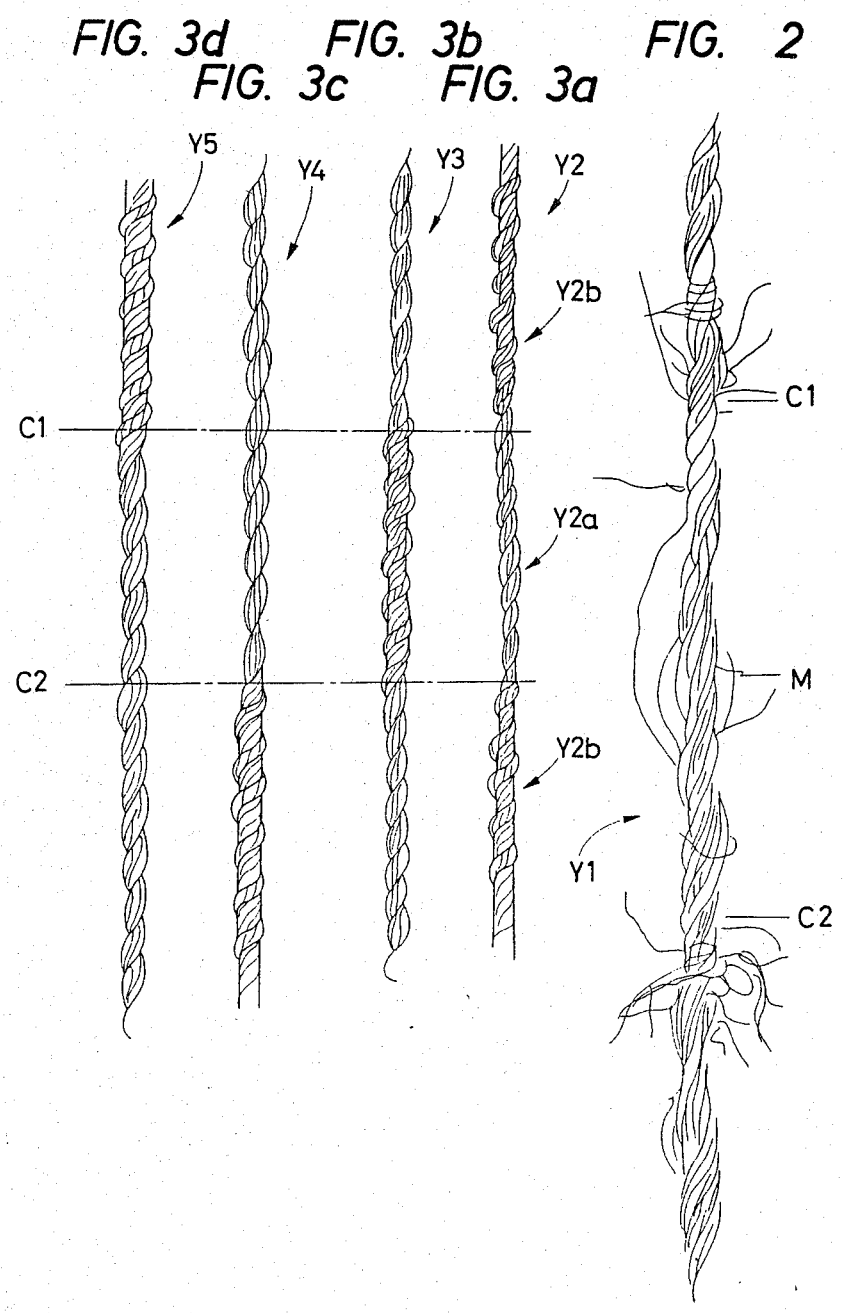
FIG. 2 is a microscopic schematic diagram of a spliced joint obtained by the method of the invention.
FIGS. 3*a*, 3*b*, 3*c* and 3*d* are diagrammatic representations showing various spliced joints.

Examples of joints formed by such splicing are illustrated in FIGS. 2 and 3. FIG. 2 is an illustrative view of a spliced joint wherein yarn ends are untwisted over an entire area of overlapping portions thereof. From FIG. 2, it can be seen that the spliced joint Y1 is in the form of a single yarn having an actual twist (Z twist) in the same direction over the entire area thereof such that the original two yarns cannot be distinguished from each other with fibers of the yarn ends interlaced with one another to unite the both yarns into a single twisted yarn. In this case, a spliced joint of a high quality can be obtained wherein characteristics of yarns thereat are not a bit inferior to those of an original single yarn. Besides, a joint has no antenna extending from an end of each of yarns thus spliced.

FIGS. 3*a* to 3*d* diagrammatically illustrate different structures of joints formed depending upon different untwisted conditions of yarn end portions overlapped one on the other. In the joint Y2 shown in FIG. 3*a*, fibers of both yarns between the turning flow applying point C1 and C2 are closely interlaced with one another and are thus intermixed in a manner as to disable distinction therebetween, thereby forming a segment Y2*a* in the form of a single yarn which is twisted in the same direction to the peculiar twisting direction of the yarns, with both yarn end portions wound around each other. In this case, it can be considered that both yarns are spliced to each other under the untwisted conditions as seen from FIG. 1. It is to be noted that both mutually wound portions Y2*a* and Y2*b* have windings in the same direction as the peculiar twisting direction of the yarns, thus contributing to the yarn strength to some degree. The spliced joint Y3 shown in FIG. 3*b* is in the reversed conditions, and between the turning flow applying point C1 and C2, two yarns are wound around each other in the same direction as the peculiar twisting direction of the yarns in a manner as to allow distinction between both yarns while opposite yarn end portions are closely intermixed with each other, thereby forming a spliced joint in the form of a single yarn. Further, in joints Y4 and Y5 shown in FIGS. 3*c* and 3*d*, two yarns are interlaced, on either one side of an area defined by both turning flow applying points, with each other in a manner as to allow distinction therebetween.

As seen from the examples of joints shown in FIG. 3, any joint has, over the entire area thereof, an actual twist in a direction coincident to the twisting direction peculiar to the yarns to be spliced regardless of a section in which both yarn ends are united into a single yarn or regardless of another section in which both yarns are wound around each other in a manner as to allow distinction therebetween. Accordingly, any joint will present substantially the same characteristics of the yarn strength, yarn thickness, stretch, number of twists, and so on, as those of a single yarn.

It is to be noted that the joints of FIGS. 3*a* to 3*d* are shown only in a schematic representation, and actually, a joint will vary in configuration depending upon various conditions, such as, for example, pressure of applied air, quantity of air, an inner bore of an injection nozzle for an air flow, angular disposition of a nozzle injection hole, number of injections, and so on. Also, joints will vary depending upon types of yarns to be spliced, length of fibers, degree of untwisted conditions, and so on.

Now, an embodiment of an apparatus in which such a joint as described above can be obtained will be described in detail with reference to the accompanying drawings.

Figure 4:
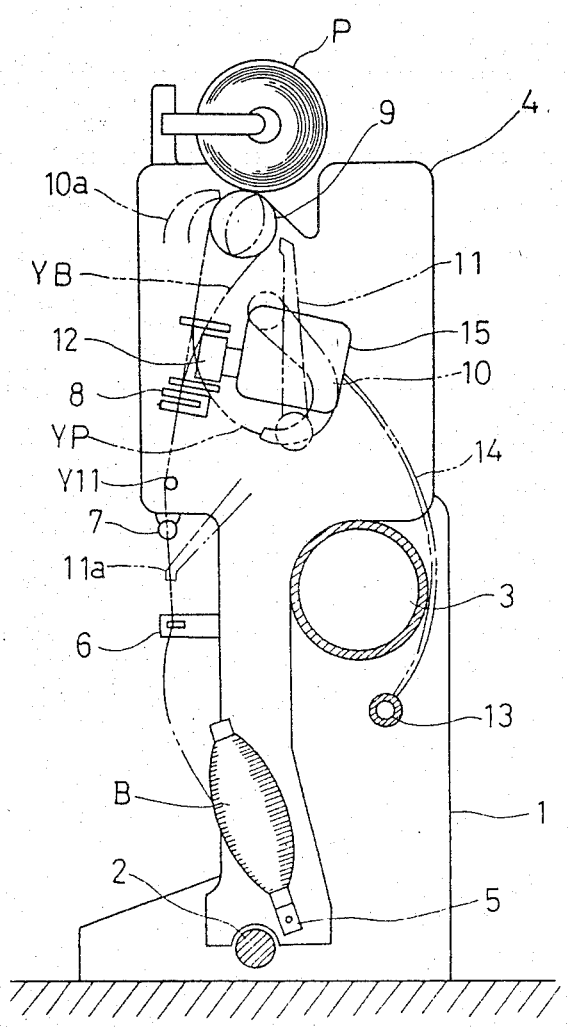
FIG. 4 is a schematic diagram of a winder which has a yarn splicing device.

FIG. 4 is a schematic view of an automatic winder to which a yarn splicing apparatus according to the present invention is to be applied. The automatic winder includes a pair of side frames 1 between which a rod 2 and a suction pipe 3 extend. A winding unit 4 is pivotally mounted on the rod 2, and during operation of the automatic winder, it lies also on the pipe 3 and is fixed thereto by a suitable means. The pipe 3 is connected to a blower not shown and is always acted upon by a suction air flow.

By the winding unit 4, a yarn is rewound from a bobbin B onto a package P. In particular, a yarn Y11 withdrawn from the bobbin B on a peg 5 passes a guide 6, a tenser 7 and a detecting device 8 which serves both for detection and cutting off of yarn irregularities such as slubs and for detection of yarn passage, and is finally wound on the package P which is rotated by a winding drum 9.

If an irregularity of the yarn is detected by the detecting device 8, a cutter disposed near the detecting device 8 is rendered operative to cut the running yarn Y11 and the winding operation is interrupted while a yarn splicing operation is initiated. In particular, a first suction mouth 10 is rendered operative to lead a yarn YP on the package side while a relay pipe 11 is rendered operative to lead a yarn YB on the bobbin side, both to a yarn splicing apparatus 12 installed at a position spaced from the normal yarn running path Y11. After completion of splicing of both yarns YP and YB with the yarn splicing apparatus 12, rewinding of the yarn will be resumed. The suction mouth 10 and the relay pipe 11 are connected to the suction pipe 3 through which a suction air flow acts. The yarn splicing apparatus 12 includes a yarn splicing unit 15 which is connected, by means of a conduit 14, to a pipe 13 connecting to a pressure air supply source of another circuit so that a fluid such as compressed air may be utilized therefor.

Figure 5:
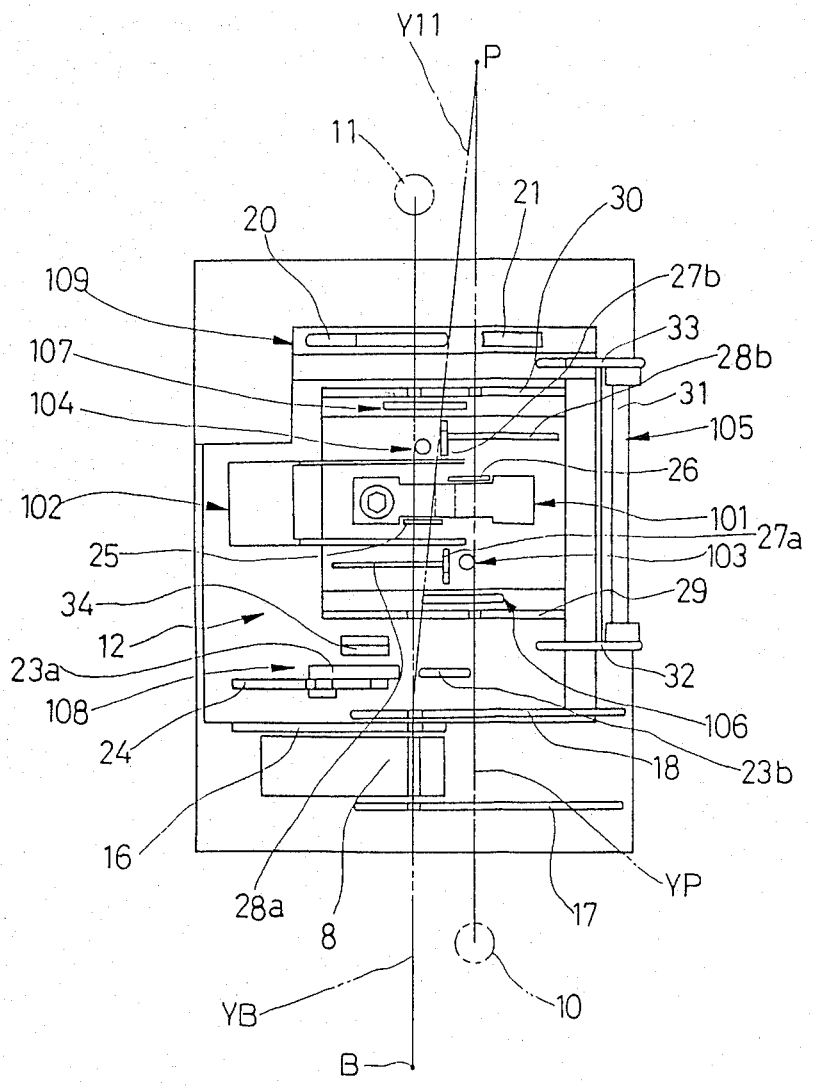
FIG. 5 is a front elevational view showing a general construction of the yarn splicing device.
Figure 6:
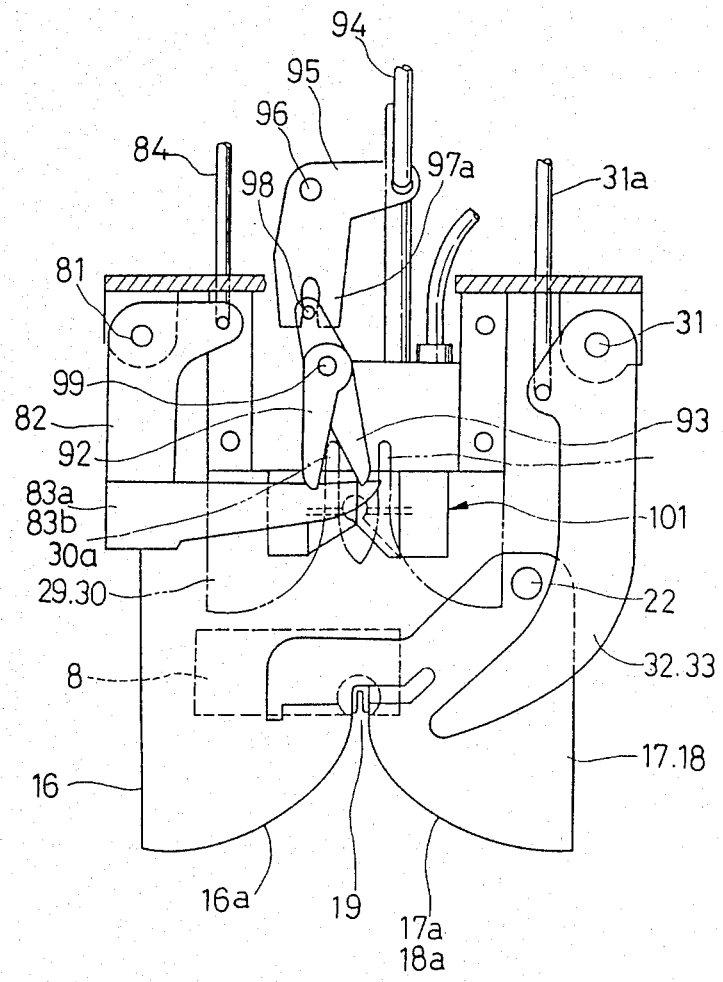
FIG. 6 is a plan view of the yarn splicing device.

General constructions of the yarn splicing apparatus 12 are shown in FIGS. 5 and 6. During normal rewinding operation, the yarn Y11 takes a passage starting from the bobbin B, passing the detecting device 8, a fixed guide 16 located adjacent one side of the detecting device 8, and pivotal guides 17 and 18 located adjacent opposite sides of the detecting device 8, passing over the yarn splicing apparatus 12, and getting to the package P.

Figure 7:
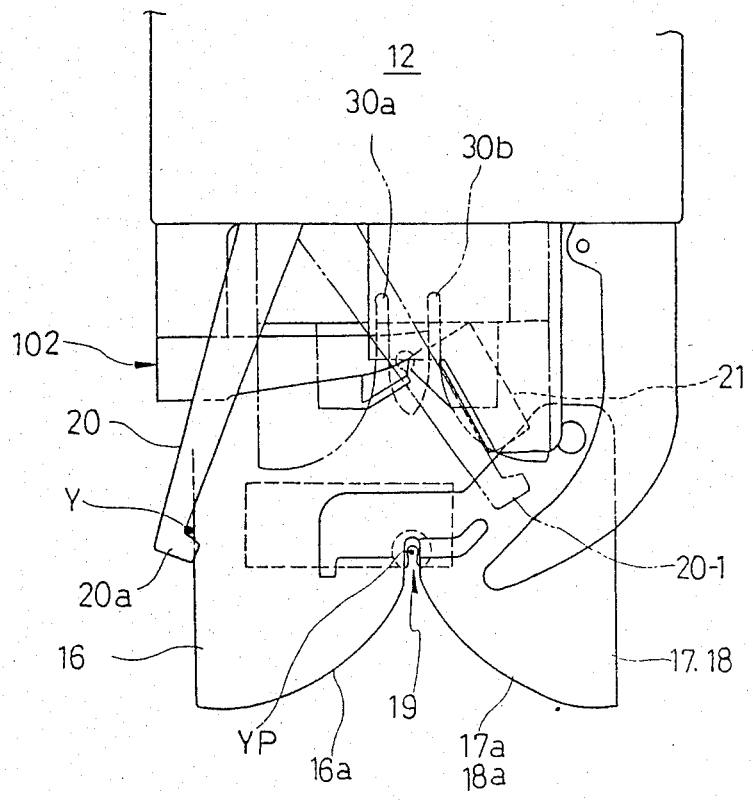
FIG. 7 is a plan view illustrating operation of a clamp device.

The yarn splicing apparatus 12 is basically composed of a yarn splicing member 101, a yarn pressing device 102, yarn end untwisting nozzles 103 and 104, a yarn handling lever 105, yarn cutting device 106 and 107, and yarn clamp devices 108 and 109. Sucking openings at ends of the suction mouth 10 and the relay pipe 11 are turningly moved above the yarn splicing device 12 in such a manner as to cross each other until they suck therein yarn ends YP and YB on the package P side and the bobbin B side, respectively, and stop at respective positions outside the yarn splicing apparatus 12. It is to be noted that the suction mouth 10 and the relay pipe 11 do not operate at the same time and thus operate with some time lag. In particular, at first the yarn end YP on the package P side is moved to a position outside the yarn splicing apparatus 12 by pivotal motion of the suction mouth 10, and substantially at the same time with stopping of such motion, a turning lever 20 of the yarn clamp device 109 on the package P side is turned in a counterclockwise direction to a phantom position 20-1 as shown in FIG. 7 by means of a control cam not shown until it is abutted against and stopped by a support block 21 secured in a fixed position. At this instant, the yarn YP is caught and moved by a hooked portion 20*a* of the turning lever 20 until it is clamped between the support block 21 and the turning lever 20.

Figure 8:
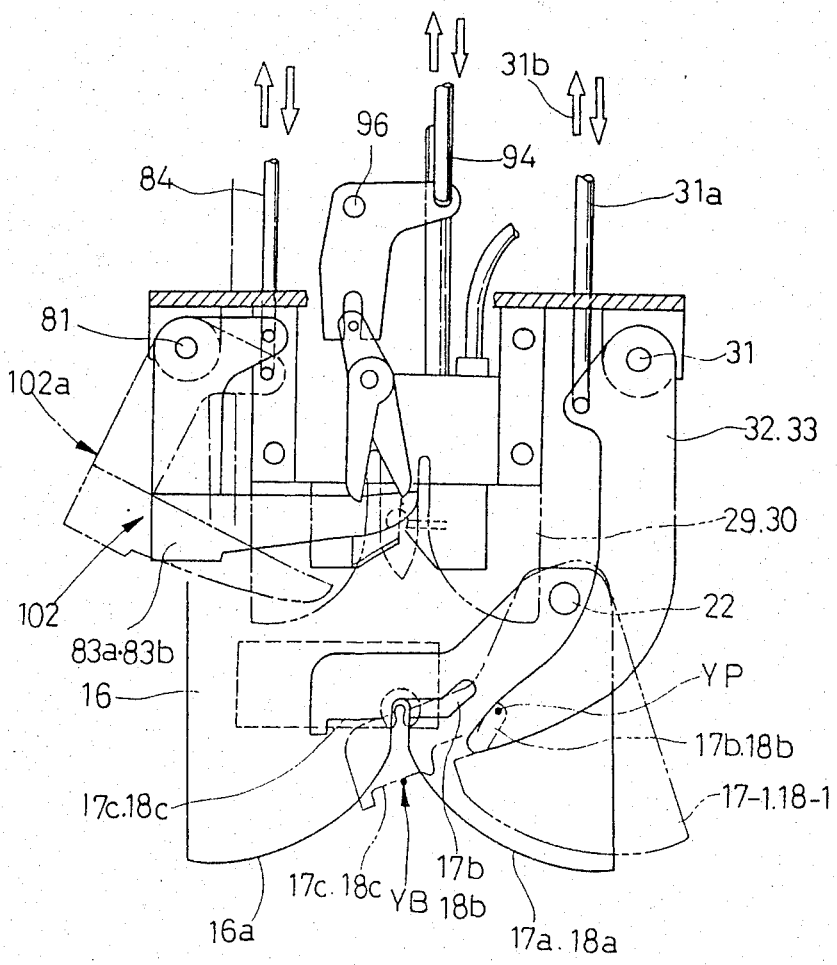
FIG. 8 is a plan view showing a structure including a yarn holding device, a cutting device and a pivotal guide plate.

In the meantime, while the turning lever 20 is operating, the yarn YP positioned on the fixed guide 16 and the pivotal guides 17, 18 is guided by inclined faces 16*a*, 17*a*, 18*a* of the guides 16, 17, 18, respectively, and is fitted into a guide groove 19 so that the detecting device 8 provided at the same position as the guide groove 19 may effect confirmation whether there is a yarn YP present in the guide groove 19 or not, confirmation whether two or more yarns are sucked in the suction mouth 10 in error or not, and so on. After confirmation of the yarn YP, the pivotal guides 17, 18 are pivoted in a counterclockwise direction about a pivot 22 as shown in FIG. 8 by means of a control cam not shown, and as a result, the yarn YP is removed from the detecting device 8 and is fitted into relief grooves 17*b*, 18*b* of the pivotal guides 17, 18.

Further, substantially at the same time with the pivotal motion of the pivotal guides 17, 18, the yarn end YB on the bobbon B side is sucked by the relay pipe 11 and is then pivotally moved in the opposite direction to that of the suction mouth until it is stopped at a position outside the yarn splicing device 12. Substantially at the same time with stopping of the pivotal motion of the relay pipe 11, a support plate 23*a* for the yarn clamp device 108 is moved in the same direction with the pivotal lever 20 along a guide plate 24 by means of a control cam not shown, catching the yarn YB thereon, until it is abutted against and stopped by a support block 23*b* secured in a fixed position to clamp the yarn YB between the support plate 23*a* and the support block 23*b*. At this instant, the yarn YB is caught by hooked portions 17*c*, 18*c* provided near the guide extremities of the pivotal guides 17, 18, respectively, as seen in FIG. 8, and a checking operation by the detecting device 8 is performed after completion of the yarn splicing operation.

The yarn splicing member 101 is disposed substantially in the center of the yarn splicing apparatus 12, and on opposite sides of the yarn splicing member 101, there are provided orderly yarn end control plates 25, 26, a yarn holding down device 102, untwisting nozzles 103, 104, guide plates 27*a*, 27*b* and guide rods 28*a*, 28*b*, yarn cutting devices 106, 107 and fork guides 29, 30. The yarn handling lever 105 is disposed on a side of the yarn splicing device 101 and includes a pivot 31 and levers 32, 33 pivotally mounted on the pivot 31. After the yarn ends YP, YB formed by cutting of the yarn Y11 with a cutting device not shown due to detection of a slub or the like of the yarn Y11 by the detecting device 8 have been guided to a position outside the yarn splicing apparatus 12 by operation of the suction mouth 10 and the relay pipe 11, the yarn ends YP, YB are introduced toward the yarn splicing apparatus 12. The range of pivotal motion of the yarn handling lever 105 is defined by a stop 34 which is positioned between the fork guide 29 and the yarn clamp member 108.

Figure 9:
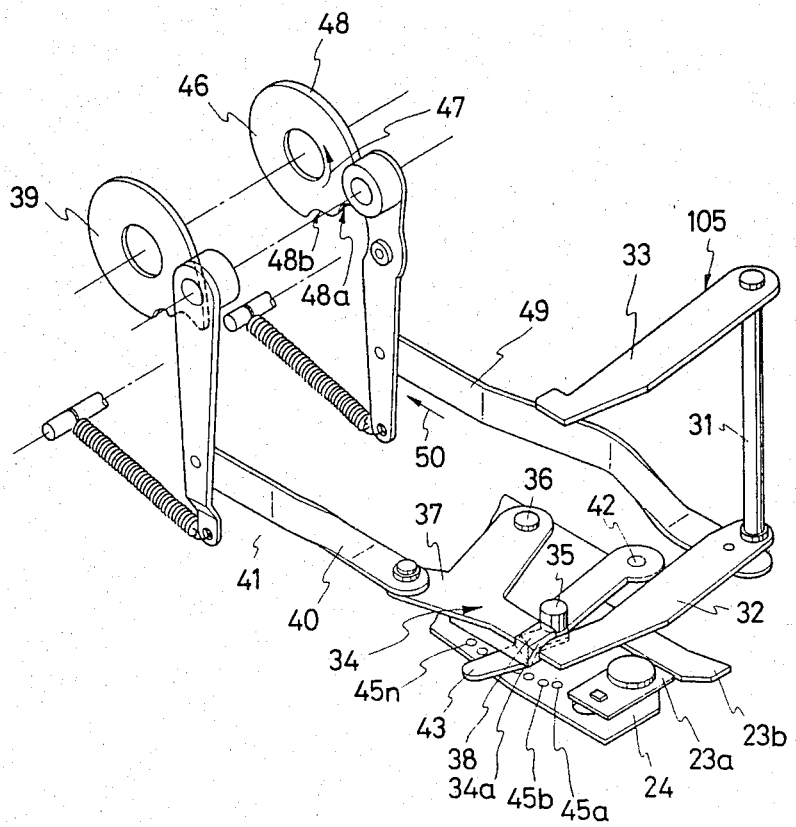
FIG. 9 is a perspective view showing a stop for a yarn handling lever.
Figure 10:
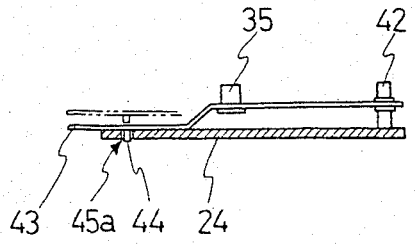
FIG. 10 is a schematic illustrating showing an adjusting operation of a position changeable stop.

The stop 34 is mounted for movement between two positions, and the position at which the yarn handling lever 105 is stopped by the stop 34 is a fixed position, the stop 34 being operative upon the yarn handling lever 105 when a yarn cutting operation is performed by the yarn cutting device. Another stop 35 for adjustment of the length of overlapping portions of yarn ends is provided as seen in FIG. 9. In particular, referring to FIG. 9, the first stop 34 includes a block 38 secured at an end of a lever 37 which is mounted for pivotal motion between two positions around a fixed pivot 36. The stop 34 is operated by a rod 40 operatively associated with a control cam 39 so that it can be moved and fixed to an operative position as shown in FIG. 9 and another inoperative position as shown in FIG. 9 and another inoperative position pivotally spaced in the direction of an arrow mark 41 from the operative position. In particular, when a yarn cutting operation is to be performed by the yarn cutting devices 106, 107, the lever 32 of the yarn handling lever 105 is in a position abutted against the first stop 34 to keep constant the lenth or distance from a clamped point to the extremity of the yarn end. Meanwhile, the second stop 35 is secured to an adjusting lever 43 which is mounted for pivotal motion around a fixed pivot 42. As shown in FIG. 10, a pin 44 is fixedly mounted on the bottom face of the lever 43 and is disposed for selective engagement with positioning holes 45*a* to 45*n* perforated along an arcuate line in the guide plate 24 in order to selectively determine the position of the second stop 35.

If a cam 46 is rotated in the direction of an arrow mark 47, a rod 49 is allowed to be pulled in the direction of another arrow mark 50 due to a cam face 48*a* of the cam 48, and hence the lever 32 is pivoted to the position abutted against the first stop 34*a*. Thereupon, a yarn cutting operation is performed. Then, the lever 32 is once pivoted back in the opposite direction whereupon yarn ends thus cut are sucked into an untwisting nozzle, which will be described hereinafter. Subsequently, the lever 32 is again allowed to be pivoted due to another cam face 48*b* of the cam 48 to the position defined by the second stop 35. In this case, the first stop 34 has already been pivotally moved to the inoperative position thereof, that is, a position behind the second stop 35, by operation of the cam 39. In particular, by pivotal motion of the lever 32 until it is abutted against the second stop 35, the amount or extent of yarn ends to be drawn out from an untwisting nozzle, that is, an extent over which yarn ends are overlapped one on the other on the yarn splicing apparatus, is determined. As the amount of pivotal motion of the yarn handling lever is set greater, the amount of yarn ends to be drawn out increases thereby to reduce the extent or distance over which the yarn ends are overlapped one on the other.

Figure 11:
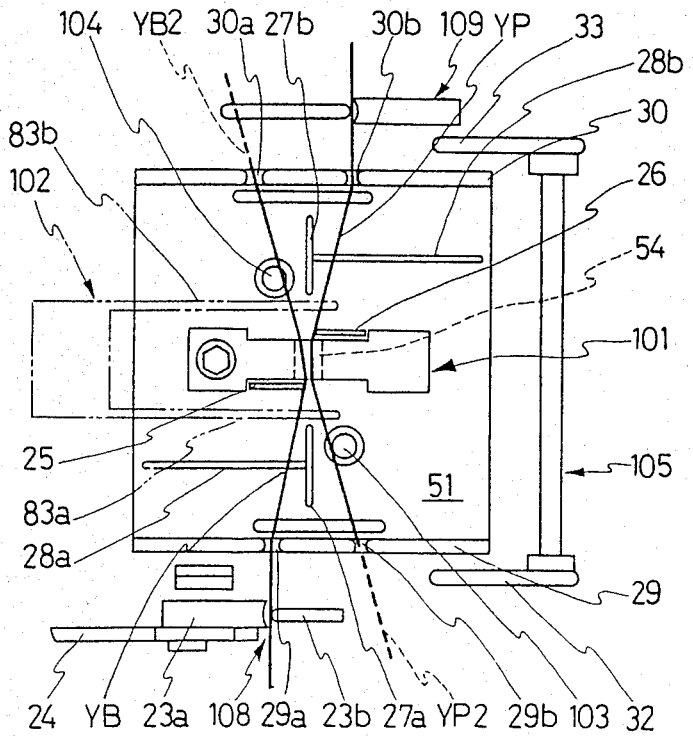
FIG. 11 is a front elevational view showing yarn ends YP, YB introduced into the yarn splicing device.
Figure 12:
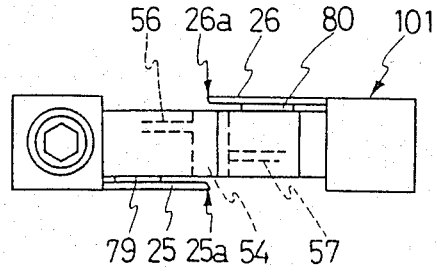
FIG. 12 is a front elevational view illustrating relative positions of a yarn splicing member and a control plate.
Figure 13:
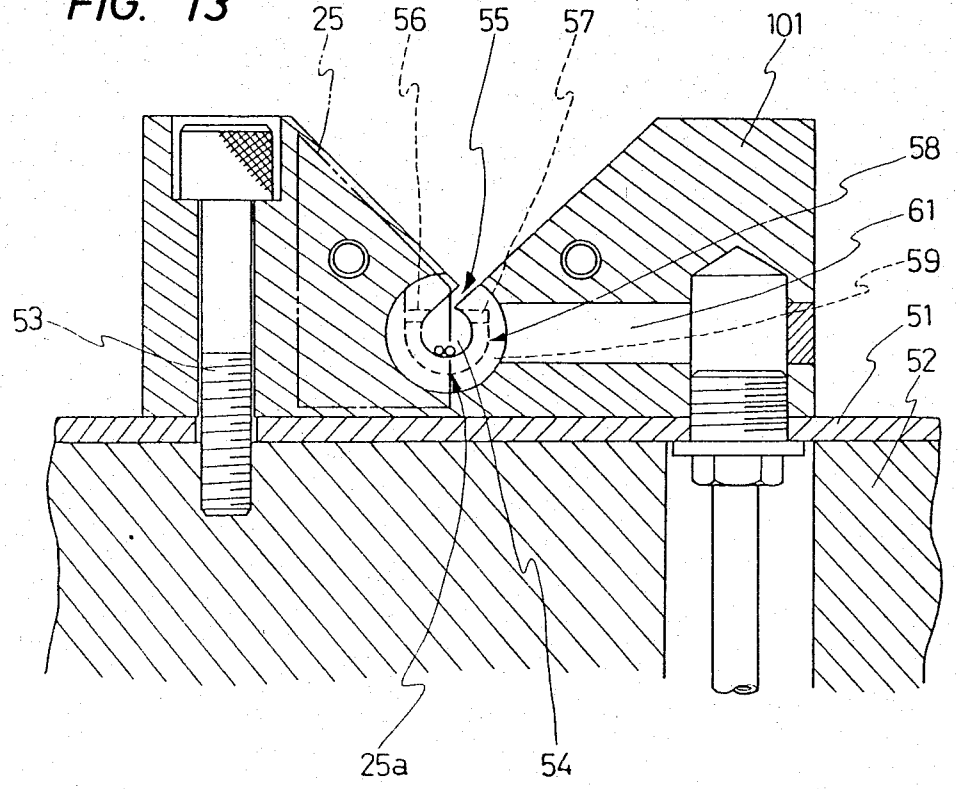
FIG. 13 is a cross sectional plan view showing an example of the yarn splicing member.

The yarn splicing member 101 is shown in FIGS. 11 to 13. The yarn splicing member 101 is screwed 53 onto a bracket 52 via a front plate 51 and has a cylindrical yarn splicing hole 54 perforated substantially in the center thereof while it has a slit 55 formed therein which extends in a tangential direction of and along the full length of the yarn splicing hole 54 thereof in such a manner as to facilitate insertion of yarns YP, YB into the yarn splicing hole 54 from outside. The yarn splicing member 101 further has fluid injection nozzle holes 56, 57 perforated therein which open tangentially to the yarn splicing hole 54.

Figure 14:
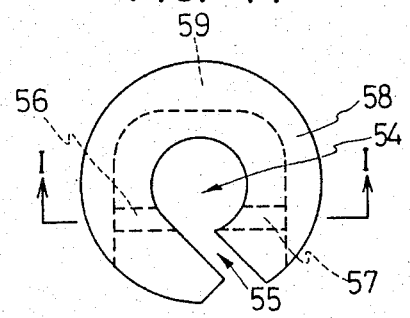
FIGS. 14 to 16 show an example of a yarn splicing nozzle unit.
Figure 15:
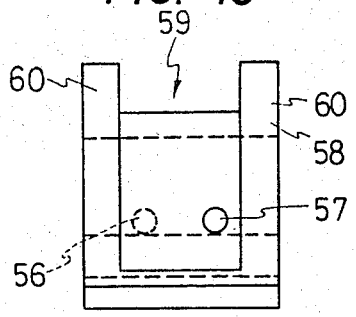
Figure 16:
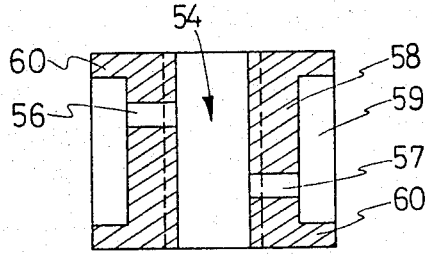

It is to be noted that the yarn splicing member 101 shown in FIG. 13 has a yarn splicing nozzle unit 58 removably fitted therein in which the yarn splicing hole 54 is formed. And an embodiment of a yarn splicing nozzle is illustrated in FIGS. 14 to 16. In particular, the yarn splicing nozzle unit 58 has substantially a cylindrical configuration and has formed therein a cylindrical yarn splicing hole 54 and two injection nozzle holes 56, 57 which open tangentially to the yarn splicing hole 54 and are disposed to open at positions so as to cause flows of fluid injected from the openings to be directed in opposite turning directions. The nozzle holes 56, 57 are further opened to a fluid path 59 formed around a cylindrical nozzle 58. In the condition in which the nozzle 58 is fitted in the yarn splicing member 101, the path 59 cooperates with a circumferential wall face of a nozzle accommodating hole formed in the yarn splicing member 101 and with upper and lower flange portions 60 of the nozzle to define a closed path. The path 59 is partially communicated with a fluid supply path 61 formed in the yarn splicing member 101. The two separately located fluid injection nozzle holes 56, 57 correspond to the turning flow applying points C1, C2 of FIG. 1, respectively, and the turning direction of a turning flow from the nozzle hole 56 corresponds to the direction X1 while the turning direction of a turning flow from the other nozzle hole 57 corresponds the direction X2, thus keeping a corresponding relationship to FIG. 1.

Figure 17:
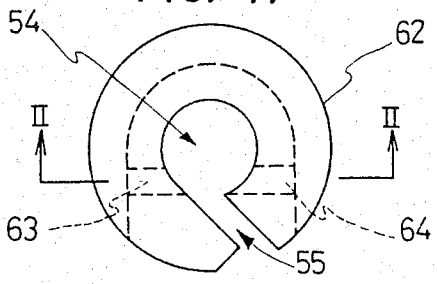
FIGS. 17 to 19 show another example of a yarn splicing nozzle unit.
Figure 18:
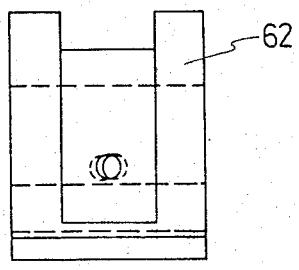
Figure 19:
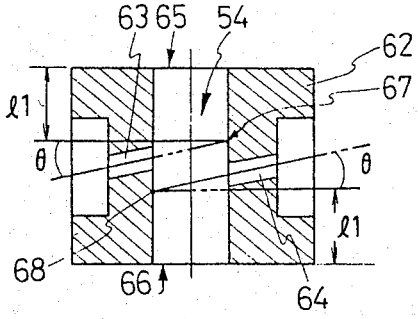

A yarn splicing nozzle unit 62 shown in FIGS. 17 to 19 is another embodiment and has nozzle holes 63, 64 formed in inclined relationship relative to an axis of the yarn splicing hole 54 such that the nozzle hole 63 is inclined toward an end face 65 of an opening while the other nozzle hole 64 is inclined toward the other end face 66 of the opening, the inclinations of both nozzle holes 63, 64 being equal to each other. The nozzle holes 63, 64 are formed in a spaced relationship sufficient to prevent air flows injected therefrom from interfering with each other. Further, the distance l1 between the opening end faces 65, 66 and points 67, 68 on wall faces of the nozzle holes 63, 64 which are first acted upon by air flows injected from the nozzle holes 63, 64 must be greater than zero and must necessarily have a sufficient dimension so that sufficient turning flows can be assured within the yarn splicing hole, that is, a sufficient amount of turning motion of fluid may be assured to perform intended splicing of yarns. If the distance l1 is too short, then air flows injected from the nozzle holes 63, 64 will directly escape from within the yarn splicing hole, disabling intended splicing of yarns.

Due to such inclination of the nozzle holes 63, 64 toward end faces of the opening, the possibility is increased to cause turning fluid flows to reach extremity portions of yarn ends located outside the yarn splicing hole, and thus a winding force can be applied up to the extremities of yarn ends overlapped one on the other. As a result, a joint can be formed uniformly over the entire extent of the overlap of the yarn ends, and it is possible to prevent formation of so-called antennae which are left to extend from a surface of a spliced joint, thus contributing to improvement of the yarn strength.

Figure 20:
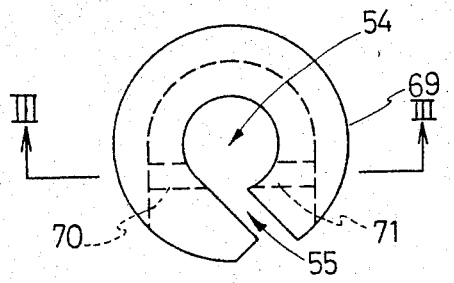
FIGS. 20 to 22 show a further example of a yarn splicing nozzle unit.
Figure 21:
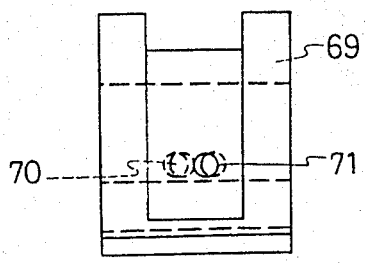
Figure 22:
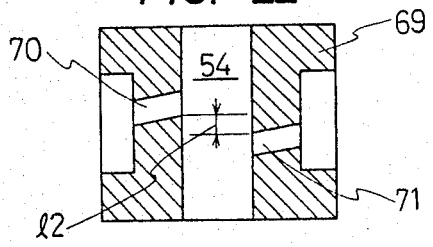

FIGS. 20 to 22 show a further embodiment of a yarn splicing nozzle wherein the distance l2 between nozzle holes 70 and 71 formed in inclined relationship toward openings on opposite ends of the yarn splicing hole 54 is significantly increased such that openings of the nozzle holes 70, 71 adjacent to each other are formed in an axial spaced relationship by the distance l2 in an inner circumferential face of the yarn splicing hole 54 in order to eliminate interference of fluid flows injected from the nozzle holes 70, 71. Accordingly, fluid injected from the nozzle holes 70, 71 will effectively make turning flows for splicing, thus contributing to promotion of a yarn splicing action and formation of a strong spliced-joint.

Figure 23:
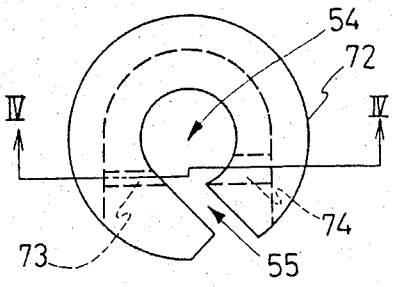
FIGS. 23 to 25 show a still further example of a yarn splicing nozzle unit.
Figure 24:
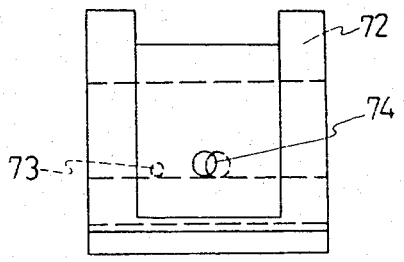
Figure 25:
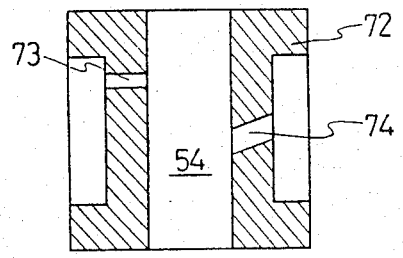

FIGS. 23 to 25 show a still further embodiment of a yarn splicing nozzle wherein one nozzle hole 73 of a yarn splicing nozzle unit 72 is formed in perpendicular relationship to an axis of the yarn splicing hole 54 while the other nozzle hole 74 is inclined relative to the axis of the yarn splicing hole 54 so as to allow a turning fluid flow to be produced which is directed toward an end face of the opening. The nozzle hole 73 has a smaller diameter than the other nozzle hole 74. In this case, a yarn splicing action is obtained principally from fluid flows from the nozzle hole 74, but since a winding force of a yarn end adjacent the upper end of the opening becomes rather weak, fluid is additionally injected from the nozzle hole 73 to promote winding actions of the upper yarn end around the other yarn. As a result, the spliced joint produced has uniform twists over the entire area thereof and thus has no relatively weak portion thereon.

It is to be noted, however, that any of the yarn splicing nozzle units 58, 62, 69 and 72 described hereinabove has a pair of nozzle holes which have, at tangential positions adjacent the slit for insertion of yarns, openings located in opposing relationship as viewed in plan: this is because, while fluid flows injected from the nozzle holes 57, 64, 71 and 74 on one hand may not possibly flow out of the slit 55, fluid flows injected from the other nozzle holes 56, 63, 70 and 73 will possibly flow out of the slit since the direction of such fluid flows is coincided with the direction of the slit, and therefore, thanks to an arrangement in which injected fluid flows from the nozzle holes 56, 63, 70, 73 are first advanced linearly across the position of the slit so that fluid flows which are turned along the inner circumferential wall face of the yarn splicing hole may be interrupted by such linearly advancing fluid flows, leakage of fluid from the slit is reduced to the utmost.

Figure 26:
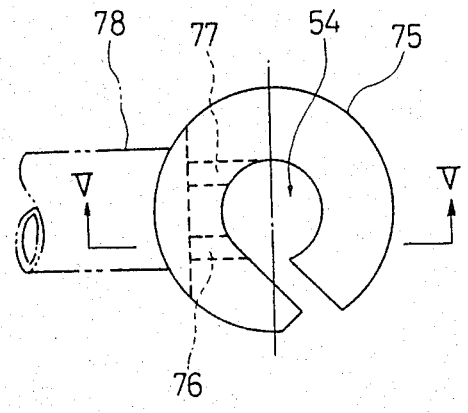
FIGS. 26 to 28 show a modified example of a yarn splicing nozzle unit having a nozzle hole disposed at a different position.
Figure 27:
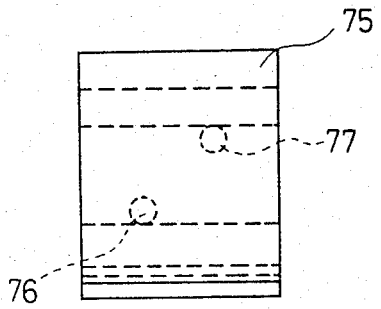
Figure 28:
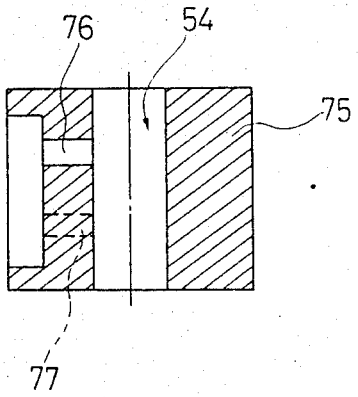

Further, it is also possible to dispose a pair of nozzle holes 56 and 57, 63 and 64, 70 and 71, or 73 and 74 on the same side relative to a plane which contains the center of the yarn splicing hole. In particular, as shown by a yarn splicing nozzle unit 75 of FIGS. 26 to 28, nozzle holes 76 and 77 are provided on the same side. In this case, installation of a supply pipe 78 for supplying compressed fluid to the nozzle holes 76, 77 becomes easier than the foregoing cases. This is because, where the nozzle holes are directed in opposite directions to each other, if a supply path 61 is formed, for example, in a manner as shown in FIG. 13, there will appear a time lag between fluid injections from the nozzle holes 56, 57. It is to be noted that areas of transverse cross sections of the supply path 61 and the fluid path 59 around the nozzle 58 as shown in FIG. 13 are made equal to each other.

Referring again to FIGS. 11 to 13, control plates 25, 26 are screwed on opposite sides of the yarn splicing member 101 with spacers 79, 80 interposed therebetween, respectively. The control plates 25, 26 are each positioned such that a particular side edge 25*a* or 26*a* crosses part of the opening of the yarn splicing hole 54. Of the control plates 25 and 26, the upper one 26 is provided for controlling a yarn YP extending to a package while the lower control plate 25 is provided for controlling a yarn YB extending from a bobbin. Accordingly, the control plate 26 is disposed on the side facing the nozzle hole 56 while the other control plate 25 is disposed on the opposite side facing the other nozzle hole 57.

In particular, the control plate 25, 26 cooperate with the yarn holding down lever 102, which will be described hereinafter, to position two yarns inserted in the yarn splicing hole 54 in a mutually contacted position so as to control flows of fluid in such a manner as to assure first winding of both yarn ends when fluid is injected, to prevent untwisting when both yarns are turned in a separate condition, to control the flow rate of fluid flowing out from openings at opposite ends of the yarn splicing hole 54, to prevent yarn ends from leaping out of the yarn splicing hole 54, to control turning motion of the clamped original yarns, and to promote yarn end portions to be wound sufficiently around their counterparts. In particular, if the yarn ends YP, YB are acted upon by injected fluid, then a balloon is produced. Here, if the rotational frequency of such a balloon rises, then fibers near a balloon neck will come off by a yarn brandishing action of the balloon, resulting in increase of probability of yarn breaks. In consideration of these circumstances, the control plates 25, 26 are provided to control the rotational frequency of a balloon which is suitable for splicing of yarns.

Further, the yarn holding down device 102 which is disposed to extend along opposite sides of the yarn splicing member 101 as shown in FIGS. 6, 8 and 11 is provided to draw out, in association with pivotal motion of the yarn handling lever 102 as described hereinafter, the yarn ends YP, YB which have been untwisted by the yarn end untwisting nozzles 103, 104 from the yarn end untwisting nozzles 103, 104 and to place the yarn ends YP, YB in position within the yarn splicing hole 54 of the yarn splicing member 101 as well as to control relative positions of the yarns YP, YB in cooperation with the control plates 25, 26. In addition, the yarn holding down device 102 has a function to curve, in cooperation with guide rods 28*a*, 28*b* as hereinafter described, yarns between clamped points thereof and the yarn splicing hole to prevent propagation of untwisting actions.

Figure 29:
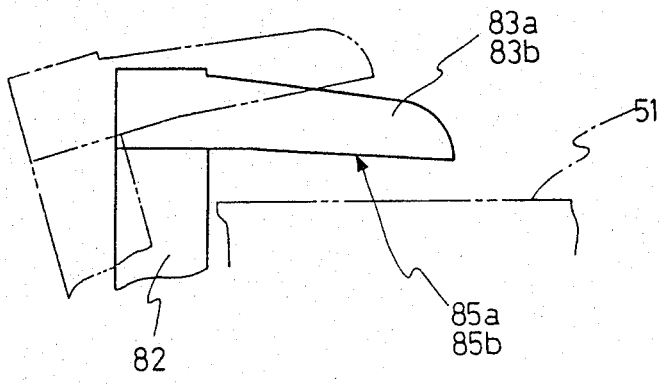
FIG. 29 is a plan view showing operation of the yarn holding device.

The yarn holding down device 102 includes a pair of yarn holding down plates 83*a*, 83*b* secured to a lever 82 which is mounted for pivotal motion around a pivot 81 secured to a fixed position as shown in FIG. 6. Thus, if a rod 84 is operated by a control cam not shown, the yarn holding down plates 83*a*, 83*b* are provided as seen in FIG. 8. Further, as shown in FIG. 29, the yarn holding down plates 83*a*, 83*b* are each forked toward their ends and thus have a same configuration. Yarn holding down side edges 85*a*, 85*b* of the yarn holding down plate 83*a*, 83*b* are, upon operation, in their upper positions above a front plate 51 which is secured to the yarn splicing member so that yarns cannot be clamped between the yarn holding down plates 83*a*, 83*b* and the front plate 51.

Figure 30:
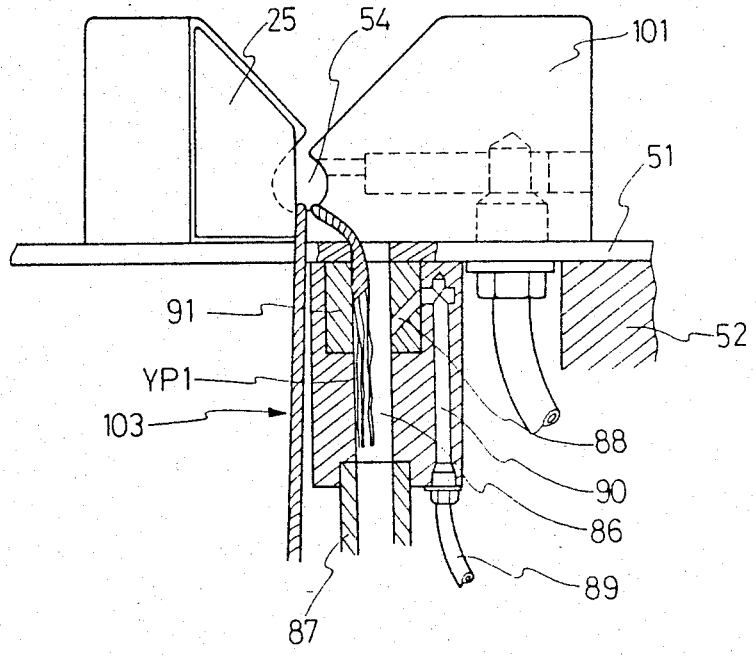
FIG. 30 is a cross sectional plan view showing an example of an untwisting nozzle.

The yarn end untwisting nozzles 103 and 104 disposed on opposite sides of the yarn holding down devices 102 have a same structure and hence only one nozzle 103 will be described with reference to FIG. 30. In particular, a yarn end YP1 on the package side to be spliced is introduced into a nozzle hole 86 of a circular cross section formed in a bracket 52 by way of the yarn splicing hole 54. Such introduction of the yarn end YP1 into the nozzle hole 86 is effected by a sucking action of the aforementioned suction pipe 3 connected thereby by means of a flexible pipe 87. After the yarn end YP1 has been introduced into the nozzle hole 86, fluid is injected from a fluid injection hole 88 opened obliquely to the nozzle hole 86 to untwist the yarn end YP1 and to bring fibers of the yarn end into parallel conditions. It is to be noted that the fluid injection nozzle 88 is preferably perforated in tangential relationship to an inner circumferential face of the nozzle hole 86 so as to produce turning air flows in a direction opposite to the twisting direction of the yarn end. Supply of fluid to the fluid injection hole 88 is effected by way of a communicating hole 90 from a pipe 89 connected the aforementioned conduit 14.

It is to be noted that the length of a portion of a yarn end to be untwisted varies depending upon the position of an opening of the fluid injection hole 88 to the nozzle, or in other words, depending upon the distance of the opening from the opening face at the top of the nozzle. Accordingly, it is desirable that the position of the opening of the injection hole can be adjusted depending upon various conditions such as types of yarns made of fibers having greater or smaller average in length or else so as to assure most appropriate untwisted conditions of overlapping portions of yarn ends within the yarn splicing hole of the yarn splicing member. To this end, a sleeve 91 is fitted for back and forth movement.

Figure 31:
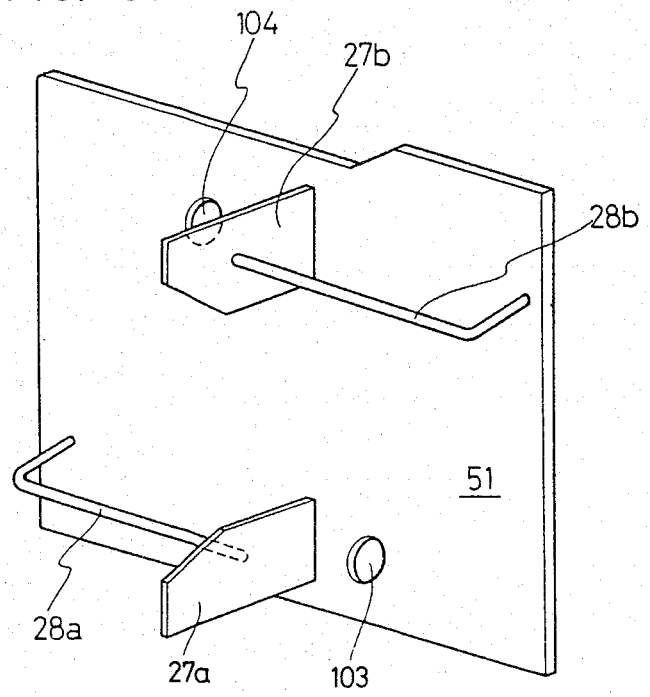
FIG. 31 is a perspective view showing relationships between a guide plate and a guide rod.
Figure 32:
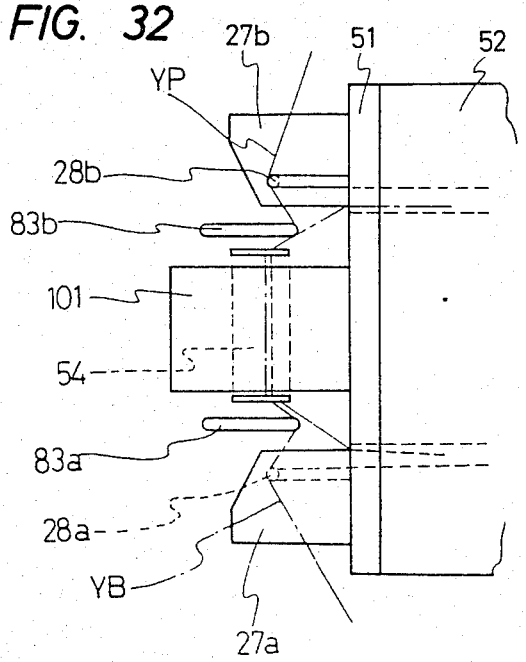
FIG. 32 is a side elevational view illustrating a yarn bent by the yarn splicing device.

Subsequently, guide means secured to the front plate 51 will be described with reference to FIGS. 11, 31 and 32. The guide plate 27*a*, 27*b* are located on a center line of the yarn splicing hole 54 and are secured uprightly to the front plate 51. The guide plates 27*a*, 27*b* are disposed, as seen in FIG. 11, such that a sucking force of the yarn end untwisting nozzles 103, 104 may not influence on portions of the yarns YP, YB which are not to be sucked. Further, the guide plates 27*a*, 27*b* each have a guide rod 28*a* or 28*b* fixedly mounted on one side face thereof in a spaced relationship from the top face of the front plate 51. The guide rods 28*a*, 28*b* extend to opposite side ends of the front plate 51 in parallel relationship with the top face of the front plate 51 and are beat thereat in L-shape and fixedly mounted at their ends on the front plate 51. Accordingly, the yarns YP, YB which are inserted into the yarn splicing hole 54 by means of the yarn handling lever 105 take a path spaced from the front plate 51 while they are contacted with the guide rods 28*a*, as seen from FIG. 32. In particular, as described hereinbefore, the guide rods 28*a*, 28*b* cooperate, during a yarn splicing operation, with the yarn holding down lever 102 to provide a curved formation to portions of yarns between the yarn splicing hole 54 and the clamp devices 108, 109 thereby to prevent propagation of an untwisting action of the yarns by a turning fluid flow within the yarn splicing hole.

Referring again to FIGS. 5, 6 and 8, the yarn cutting devices 106, 107 are provided inside the guide plate 29, 30, respectively, and each include a fixed blade 92 and a movable blade 93. If a rod 94 is operated as seen in FIG. 6 by a control cam not shown, then a forked lever 95 is pivoted in a clockwise or counterclockwise direction about a pivot 96. Upon this pivotal motion of the forked lever 95, a fork portion 97 thereof moves a support pin 98 on the opposite end of the movable blade 93 thereby to pivot the movable blade 93 about a pivot 99.

Further, the fork guides 29, 30 secured outside the yarn cutting devices 106, 107 have guide grooves 29*a* and 29*b*, 30*a* and 30*b*, as shown in FIG. 11. In addition, the yarn handling lever 105 disposed on a side portion of the yarn splicing member 101 is pivoted in a clockwise direction about the pivot 31, as shown in FIGS. 6 and 8, by a control cam not shown via a rod 31*a* to introduce the yarns YP, YB into the guide grooves 29*a* and 29*b*, 30*a* and 30*b* and then into the yarn splicing hole 54 through the slit from the inclined face of the yarn splicing member.

Now, a yarn splicing operation of the yarn splicing device will by described in detail.

(A) Yarn Preparing and Clamping Step

Referring to FIG. 4, when the detecting device 8 detects that a yarn breaks during rewinding or that a yarn layer on a bobbin has been spent up, the drum 9 stops its rotation and a single rotation clutch not shown operates to rotate a shaft thereby to operate various control cams provided on and/or in association with the shaft to effect an intended yarn splicing operation.

At first, the suction mouth 10 and the relay pipe 11 are pivoted from respective phantom positions 10*a*, 11*a* of FIG. 1 each with a yarn end sucked therein, passing over the relay device 12 in such a manner the yarn YP on the package P side and the yarn YB on the bobbin B side intersect each other, and stops at a position outside the yarn splicing apparatus.

In particular, after operation of the suction mouth 10 and before the relay pipe 11 begins its operation, the yarn clamp device 109 on the package side operates to clamp the yarn YP between the pivotal lever 20 and the support block 21 and to introduce the yarn YP into guide grooves 19 of the fixed guide 16 and the pivotal guide 17, 18 disposed adjacent the detecting device 8 which then effects checking of the yarn YP. Subsequently, the pivotal guides 17, 18 are pivoted to respective phantom positions 17-1, 18-1 around the pivot 22 to remove the yarn YP from the detecting device 8 and to receive it into relief grooves 17*b*, 18*b* thereof.

Then, the relay pipe sucks therein the yarn YB on the bobbin side B and is pivoted to a position outside the yarn splicing apparatus 12. In this case, the yarn YB passes through the hooked portions 17*c*, 18*c* of the pivotal guides 17, 18 and is clamped between the support plate 23*a* and the support block 23*b* of the yarn clamp device 108, as seen in FIG. 11.

(B) Yarn Handling and Cutting Step

After completion of the yarn clamping step, the levers 32 and 33 of the yarn handling lever 105 shown in FIGS. 5 and 11 are pivoted around the pivot 31 to introduce the yarns YP and YB on the opposite sides separately into the guide grooves 29*a*, 29*b* and 30*a*, 30*b* of the fork guides 29, 30, respectively, and to fit them into the yarn splicing hole 54 of the yarn splicing member 101 through the slit 55 therein.

Figure 33:
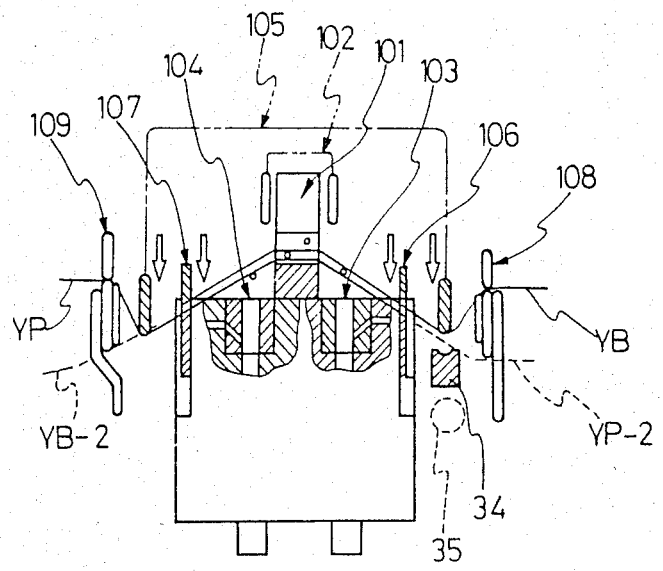
FIGS. 33 to 35 are diagrammatic representations showing different phases of a yarn splicing operation of the yarn splicing device.

Then, the yarn cutting devices 106, 107 operate to cut yarns YP2, YB2 off at positions spaced a predetermined distance from the clamp devices 108, 109, as seen in FIG. 11. The position of the yarn at which it is cut is related to the length of a spliced joint to be obtained by the intended splicing, having an influence on an appearance and the strength of a spliced joint produced, and is also related to the yarn count. In particular, referring to FIG. 33, the yarns YP, YB on opposite sides of the yarn splicing member 101 are clamped on the yarn clamp device 108 and the yarn handling lever 105 is operated, and the rod 31*a* shown in FIG. 8 is operated by a control cam not shown to move in a direction of an aroow mark 31*b* to pivot the levers 32, 33 in a clockwise direction around the pivot 31. In this condition, a yarn cutting operation is carried out. It is to be noted that, upon operation of the yarn handling lever 105 and the cutting devices 106, 107, the yarn holding down device 102 is held standby at a two dots and dash line position 102*a* of FIG. 8*a*.

(C) Yarn End Untwisting Step

Figure 34:
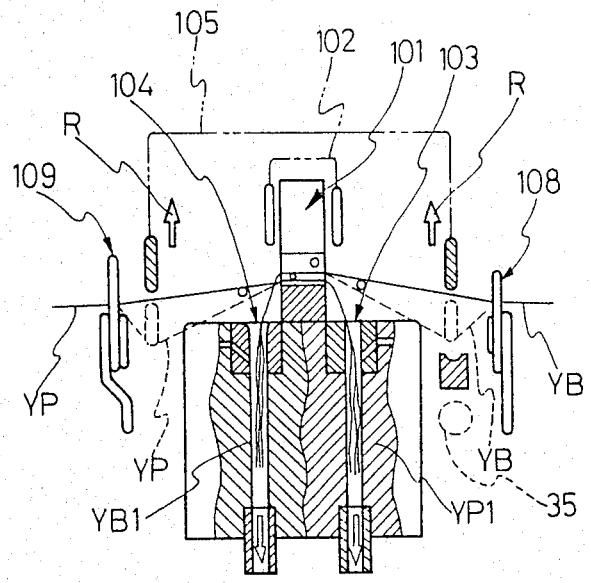

Subsequently, at the same time as or just before or after the yarn ends YP1, YB1 are sucked into the yarn end untwisting nozzles 103, 104 as shown in FIG. 34, the yarn handling lever 105 is moved in a direction R away from the yarns, and as a result, the yarn ends YP1, YB1 are sucked to the interior of the yarn untwisting nozzles 103, 104, respectively, whereafter fluid is injected as described hereinabove to untwist the yarn ends YP1, YB1 into a condition prepared for subsequent splicing thereof.

It is to be noted that a sucking operation of the yarns by the untwisting nozzles 103, 104 is preferably started just before a yarn cutting operation by the cutting devices 106, 107. It is because, when the yarn Y is cut, a tensile force is applied to the yarn due to a sucking action of the suction mouth and the relay pipe, and hence, the yarn ends YP1, YB1 which have been brought into free condition by cutting thereof would in some cases fly away from positions adjacent the openings of the untwisting nozzles 103, 104, resulting in failure of an intended yarn sucking operation by the untwisting nozzles. It is to be noted that supply of fluid to the untwisting nozzles may be effected by changing over a valve by means of a solenoid not shown.

(D) Yarn Splicing Step

Figure 35:
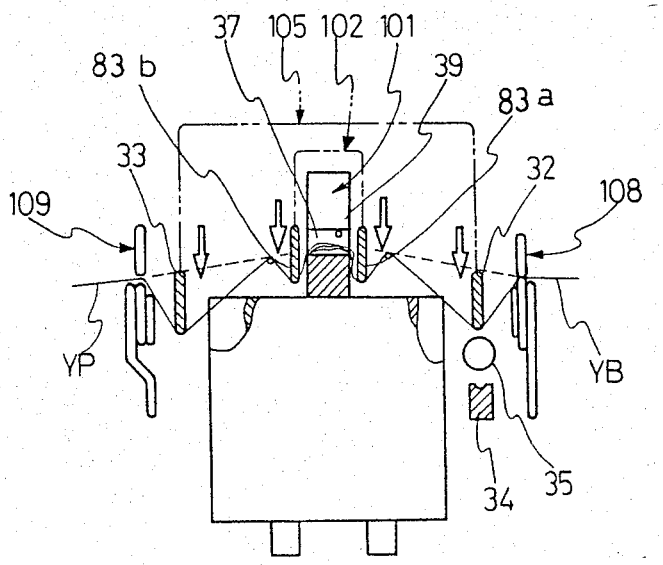

After the yarn ends YP1, YB1 have been untwisted into a condition suitable for subsequent splicing by the yarn end untwisting nozzles 103, 104, operations of the untwisting nozzles 104, 103 and the flexible pipe 87 and a sucking action through the fluid injection hole 88 are stopped. At the same time as or just before or after such stopping, the yarn handling lever 105 is operated again to guide the yarn ends YP1, YB to draw them out of the untwisting nozzles 103, 104 and to place the thus untwisted yarn ends one on the other at a predetermined position of the yarn splicing member, as shown in FIG. 35. Then, one of the levers 32 and 33 of the lever 105 is pivoted to a position abutted against the stop 35 and the yarn holding down device 102 is operated to pivot to a position as shown in FIGS. 35 and 32, thereby providing, in cooperation with the yarn holding down plates 83*a*, 83*b* and the guide rods 28*a*, 28*b*, a curved configuration to portions of the yarns YP, YB between the yarn splicing hole 54 and the clamp devices 108, 109, or more particularly, between the yarn splicing hole 54 and the yarn handling levers 32, 33. The yarn ends YP1, YB1 which have been inserted in the nozzle holes of the untwisting nozzles 103, 104 are then drawn into the yarn splicing hole 54 of the yarn splicing member 101 by the yarn handling lever 105 and the yarn holding down device 102 and are placed in position in a mutually contacted relationship by means of the control plate 25, 26 as shown in FIGS. 12 and 13 and the yarn holding down device 102.

Then, after positioning of the yarn ends, compressed fluid is injected from the fluid injection holes 56, 57 of FIG. 13 in order to effect yarn splicing with turning flows of such fluid in accordance the principle described with reference to FIG. 1. In particular, the yarn end YP is clamped at a position of a clamped point K1 and has an extremity portion B1 thereof left in a free condition while the other yarn end YB is clamped at a position of a clamped point K2 and an extremity portion A1 thereof left in a free condition. In this position, the yarn ends YP, YB are acted upon at turning flow applying points thereof by turning flows which are directed in mutually opposite directions. In a case as shown in FIG. 1, the peculiar twist of the yarn Y is a Z-twist and hence turning flows must necessarily be in opposite direct directions of arrow marks X1 and X2. However, in a case of a yarn to be spliced in which the peculiar twist is an S-twist, directions of turning flows are naturally reversed.

A spliced joint obtained in this way thus has an actual twist of the same direction (Z) as the direction of the peculiar twist of the yarn over an entire area thereof as seen in FIG. 2 and fibers thereof are interlaced with one another to form a twisted single yarn.

Results of experimental comparisons of spliced joints obtained in this way with parent or single yarns regarding the strength, stretch, number of twists, and so on, are shown below.

The experiment was conducted under the following conditions: a cotton Ne 40 comber yarn is used; as for a yarn splicing member, a nozzle as shown in FIG. 13 and in FIGS. 14 to 16 is used; and pressure of air from an air injection nozzle is 5.5 Kg/cm$^2$.

| | Joint | Parent Yarn | Maintenance Ratio |
|---|---|---|---|
| (a) Yarn Strength | | | |
| Sample Quantity | 513 | 513 | |
| Maximum (g) | 295 | 303 | |
| Minimum (g) | 148 | 162 | |
| Average (g) | 201.2 | 228.3 | 88.1% |
| Fluctuation (%) | 10.2 | 98 | |
| (b) Stretch | | | |
| Sample Quantity | 513 | 513 | |
| Maximum (mm/500 mm) | 26 | 27 | |
| Minimum | 15 | 16 | |
| Average | 20.5 | 22.2 | 92.2% |
| Fluctuation | 9.30 | 7.65 | |
| (c) Number of Twists | | | |
| Twisting Direction | Z | Z | |
| Maximum (T/inch) | 23.5 | 24.2 | |
| Minimum | 20.1 | 22.5 | |
| Average | 22.7 | 23.2 | 97.8% |

It is to be noted that, even from another experiment conducted under the same conditions except that a cotton Ne 7 comber yarn is employed, results were obtained that the maintenance ratio of yarn strength is 73.7% and the maintenance ratio of stretch is 81.8%. Thus, according to the method described hereinabove, yarn splicing is possible for a wide range of yarns from a thin yarn to a thick yarn.

According to the results of the experiments, spliced joints obtained have high maintenance ratios of the strength, stretch, number of twists and twisting direction relative to parent yarns and thus have characteristics similar to those of single yarns.

As apparent from the foregoing description, according to the present invention, ends of two yarns which are inserted in an oppositely directed and overlapped relationship in a yarn splicing hole are left free and at least such overlapped portions of yarn ends in the yarn splicing hole are acted upon at two different points thereof by flows of fluid turning in opposite directions. Hence, spliced joints thus obtained have an actual twist of the same direction as the direction of the peculiar twist of the original yarn and have a construction very similar to that of the original yarn. In this way, according to the invention, spliced joints can be obtained which are not so differentiated from their original yarn in regards to the yarn strength, stretch, number of twists, and so on.

What is claimed is:

1. A method of splicing spun yarns wherein extremities of ends of two yarns which are inserted in overlapping and oppositely directed relationship in a yarn splicing hole are spliced on the other by applying compressed fluid thereat, the method comprising the steps of:

holding said yarn ends so that the extremities of the ends of the two yarns are in free conditions; and then turning at least two portions of said yarn ends which are overlapped on the other within said splicing hole in opposite directions at respective positions thereof so that the extremity of one yarn turns around the other yarn and so that the extremity of the other yarn turns around said one yarn.

2. A method of splicing spun yarns, the method of the type wherein the extremities of the ends of two yarns are inserted in an overlapping and oppositely directed relationship within a yarn splicing hole and wherein the yarns are spliced together by applying compressed fluid to the overlapped ends, the method comprising the steps of:

(a) clamping each yarn at a point on the yarn which is spaced a predetermined fixed distance from the extremity of the yarn end;

(b) untwisting the extremity of the end of the two yarns;

(c) holding the yarns so that the untwisted extremity of the two yarn ends are in a free condition; and (d) applying the fluid to at least two portions of the overlapped yarns so that the overlapped yarn ends turn in opposite directions.

3. A method according to claim 2 wherein the turning directions are determined in association with the twisting directions peculiar to the yarns to be spliced together and wherein each turning direction is selected to be that direction in which the peculiar twist of the portion of the yarn between the clamped point of the yarn and the position where the fluid is applied is released or untwisted.

4. A method of splicing spun yarns to avoid yarn antennae, the method of the type wherein the ends of two yarns are inserted in an overlapping and oppositely directed relationship within a yarn splicing hole of a yarn splicing apparatus and wherein the two yarns are spliced together by applying compressed fluid to the overlapped yarn ends, the method comprising the steps of:

(a) holding the two yarn ends within the yarn splicing hole so that the extremity of one of the yarn ends is free to move around the other yarn and so that the extremity of the other yarn end is free to move around said one yarn; and (b) applying fluid to two portions of the two yarn ends so that the two yarn ends turn around each other in opposite directions.

5. A method of splicing spun yarns according to claim 4 wherein the fluid is applied in two streams with one fluid stream causing one yarn end to turn in one direction and the other fluid stream causing the other yarn end to turn opposite the turning direction of said one yarn end.

6. A method of splicing spun yarns according to claim 5 wherein said one direction is opposite the direction of the twist of said other yarn end.

7. A method of splicing spun yarns according to claim 4 wherein prior to step (a) the extremity of each the yarn end is untwisted.

8. An apparatus for splicing two spun yarns comprising:

a yarn splicing member body having opposed ends, the body having:

a yarn splicing hole extending between the opposed ends, a slit formed along and communicating with the yarn splicing hole to introduce yarns to be spliced into the yarn splicing hole, and two injection nozzles formed within the body and opening into the yarn splicing hole so that fluid injected through one nozzle flows in a direction opposite to the direction of the fluid injected through the other nozzle;

means for untwisting the extremity of the two yarn ends; and means for holding the two yarn ends within the yarn splicing hole so that the extremity of one yarn end is free to move around the other yarn and so that the extremity of the other yarn end is free to move around said one yarn.

9. An apparatus for splicing spun yarns comprising:

a yarn splicing member having a yarn splicing hole to which a compressed fluid injection nozzle is opened;

yarn end untwisting nozzles which are provided in the vicinity of both ends of the splicing hole to suck therein and to untwist the yarn end of the package side and the yarn end of the bobbin side, respectively;

a yarn handling lever which is disposed on one side of the yarn splicing member and includes a pivot and levers pivotally mounted on the pivot;

yarn cutting devices which are disposed at the bobbin side and the package side of the yarn splicing member, respectively; and clamp devices which are mounted at both outsides of the above mentioned devices and clamp the yarns of the package side and the yarn of the bobbin side, respectively, characterized in that said yarn splicing member includes a cylindrical yarn splicing hole perforated through a body member of the yarn splicing member, a slit formed along and communicating with the yarn splicing hole to introduce yarns to be spliced, and two injection nozzle holes which open tangentially to the yarn splicing hole and are disposed to open at positions so as to cause flows of fluid injected from the openings to be directed in opposite turning directions.

10. An apparatus as set forth in claim 9, wherein said splicing member comprises a body member and a substantially cylindrical nozzle unit removably fitted therein in which said yarn splicing hole is formed, and a fluid path is formed around the cylindrical nozzle unit to communicate with said injection nozzle holes and a compressed fluid supply path formed in the nozzle body.

11. An apparatus as set forth in claim 9 or 10, wherein said injection nozzle holes are opened in perpendicular relationship to an axis of the yarn splicing hole.

12. An apparatus as set forth in claim 11, wherein said injection nozzle holes are opened at an opposite circumferential wall of the splicing hole relative to the axis of the splicing hole, respectively.

13. An apparatus as set forth in claim 11, wherein said injection nozzle holes are opened at a same circumferential wall of the splicing hole relative to the axis of the splicing hole.

14. An apparatus as set forth in claim 9 or 10, wherein said injection nozzle holes are formed in inclined relationship relative to an axis of the yarn splicing hole and are formed in a spaced relationship sufficient to prevent air flows injected therefrom from interfering with each other.

15. An apparatus as set forth in claim 9 or 10, wherein a first injection nozzle hole is formed in perpendicular relationship to an axis of the yarn splicing hole while a second injection nozzle hole is inclined relative to the axis of the yarn splicing hole and the first injection nozzle hole has a smaller diameter than the second injection nozzle hole.

16. An apparatus as set forth in claim 9 or 10, wherein control plates are screwed on opposite sides of the yarn splicing member with spacers interposed therebetween, respectively and one of the control plate is disposed on the side facing the nearer injection nozzle hole while the other control plate is disposed on the opposite side facing the other injection nozzle hole.

17. An apparatus as set forth in any one of the claims 4 or 5, wherein said apparatus further includes a pair of guide means comprising a guide plate which is located in the vicinity of the untwisting nozzle and on a center line of the yarn splicing hole and is secured uprightly to a front plate of the splicing apparatus such that a sucking force of the yarn end untwisting nozzles may not influence on portions of the yarns which are not to be sucked, and a guide rod which is fixedly mounted on one side face of the guide plate in a spaced relationship from the top face of the front plate and extends to the side end of the front plate in parallel relationship with the top face of the front plate.

* * * * *